US011177613B2

(12) United States Patent
Germagian et al.

(10) Patent No.: US 11,177,613 B2
(45) Date of Patent: Nov. 16, 2021

(54) ELECTRICAL PLUG LATCHING SYSTEMS AND RELATED METHODS

(71) Applicant: Gateview Technologies, Inc., Harvard, MA (US)

(72) Inventors: Mark Germagian, Harvard, MA (US); Clint Veino, Hampstead, NH (US)

(73) Assignee: Gateview Technologies, Inc., Harvard, MA (US)

( * ) Notice: Subject to any disclaimer, the term of this patent is extended or adjusted under 35 U.S.C. 154(b) by 0 days.

(21) Appl. No.: 16/938,925

(22) Filed: Jul. 25, 2020

(65) Prior Publication Data

US 2021/0028576 A1 Jan. 28, 2021

Related U.S. Application Data

(60) Provisional application No. 62/879,088, filed on Jul. 26, 2019.

(51) Int. Cl.
*H01R 13/627* (2006.01)
*H01R 25/00* (2006.01)

(52) U.S. Cl.
CPC ..... *H01R 13/6275* (2013.01); *H01R 25/003* (2013.01)

(58) Field of Classification Search
CPC .. H01R 13/6275; H01R 25/003; H01R 24/22; H01R 13/6392
See application file for complete search history.

(56) References Cited

U.S. PATENT DOCUMENTS 7,722,380 B1 * 5/2010 West ..... H01R 13/6395 439/373
9,722,358 B1 * 8/2017 Galpchian ..... H01R 13/6395
2012/0034801 A1 * 2/2012 Hsu ..... H01R 13/70 439/345
2015/0357758 A1 * 12/2015 Krietzman ..... H01R 13/639 439/345

* cited by examiner

*Primary Examiner* — Briggitte R. Hammond
(74) *Attorney, Agent, or Firm* — Olive Law Group, PLLC

(57) ABSTRACT

Electrical plug latching systems and related methods are disclosed. According to an aspect, an electrical plug latching system includes a base having an interface for attachment to an electrical plug receptacle. The base defines an opening for receipt of an electrical plug for electrical connection to the electrical plug receptacle. The electrical plug defines a protrusion. Further, the system includes a latch that is attached to the base and that includes a gripper portion. The gripper portion is moveable between a first position and a second position with respect to the base. In the first position, the gripper portion is positioned to interface with the protrusion of the electrical plug to hold the electrical plug in place when electrically connected to the electrical plug receptacle. In the second position. the gripper portion is positioned apart from the protrusion of the electrical plug.

20 Claims, 11 Drawing Sheets

ELECTRICAL PLUG LATCHING SYSTEMS AND RELATED METHODS

CROSS REFERENCE TO RELATED APPLICATION

This application claims priority to U.S. patent application Ser. No. 62/879,088, filed Jul. 26, 2019, and titled A SYSTEM AND METHOD FOR LOCKING A CORD INTO A RECEPTACLE, the content of which is incorporated herein by reference in its entirety.

TECHNICAL FIELD

The presently disclosed subject matter relates generally to electrical power systems. Particularly, the presently disclosed subject matter relates to electrical plug latching systems and related methods.

BACKGROUND

A power distribution unit (PDU) is an assembly of electrical plug outlets or electrical plug receptacles that receive electrical power from a source and distribute electrical power to one or more separate electronic devices. An electronic device is electrically connected to an electrical plug receptacle via an electrical cord having an electrical plug that interfaces with the electrical plug receptacle. The PDU assembly receives power input from a power source and distributes this power to each receptacle where a plug is inserted.

PDUs are used in a variety of settings such as electronic equipment racks. In some instances, various locking mechanisms have been employed to secure an electrical cord to the receptacle. These receptacles are designed to receive typically, pronged plugs that are designed and configured to fit smoothly and tightly into similarly configured and complimentary receptacles. However, current mechanisms are cumbersome or ineffective in preventing micro-gaps and they can fail to secure the electrical plug to the receptacle such that power is conducted therebetween. Further, in some efforts, the mechanisms occupy a significant amount of space and therefore valuable receptacle space was lost and ultimately larger PDUs were required to achieve the same level of functions and accessible receptacles.

In view of the foregoing, there is a need for providing PDUs and other systems with receptacles with improved locking mechanisms.

BRIEF DESCRIPTION OF THE DRAWINGS

Figure 1:
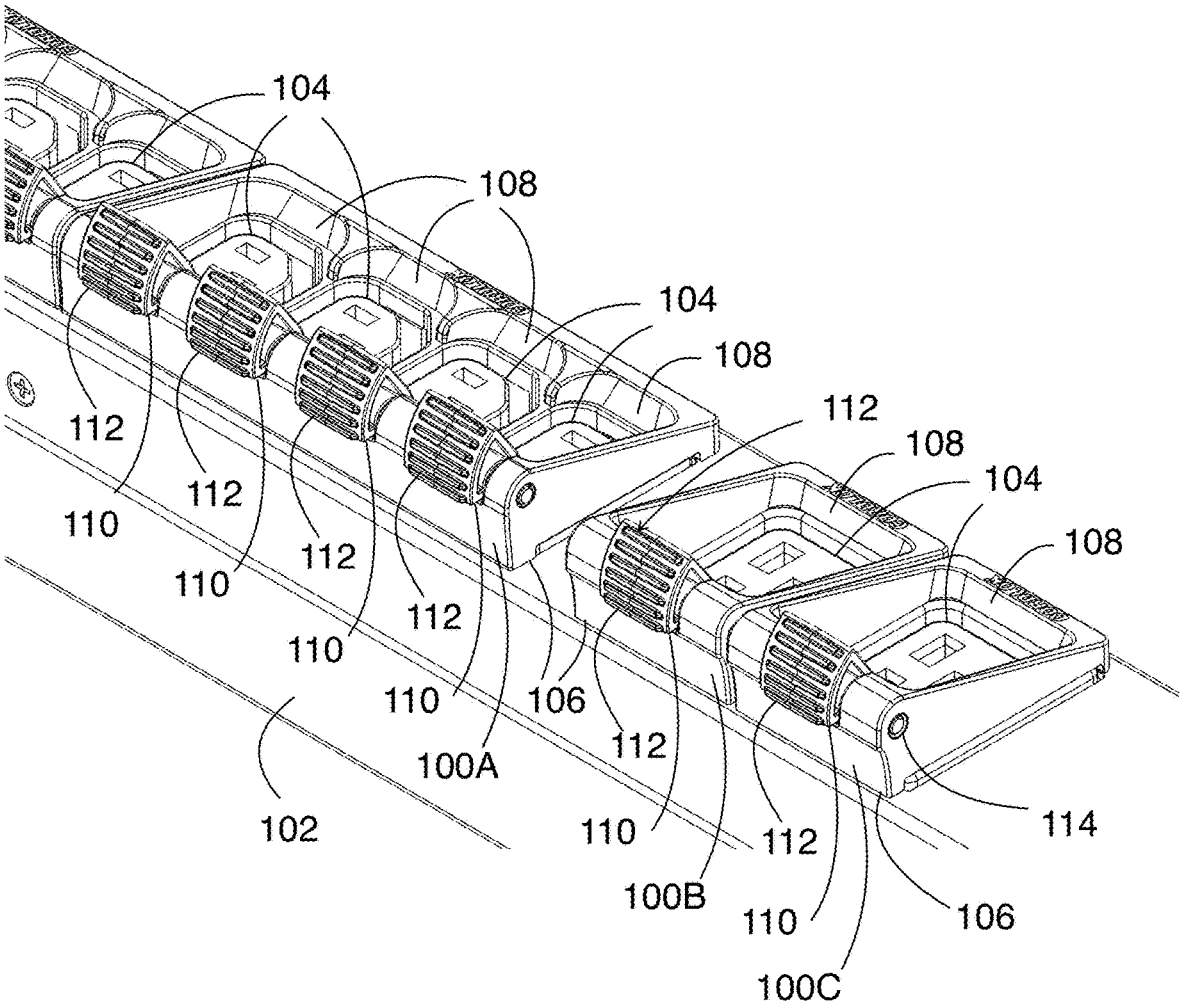
Figure 2:
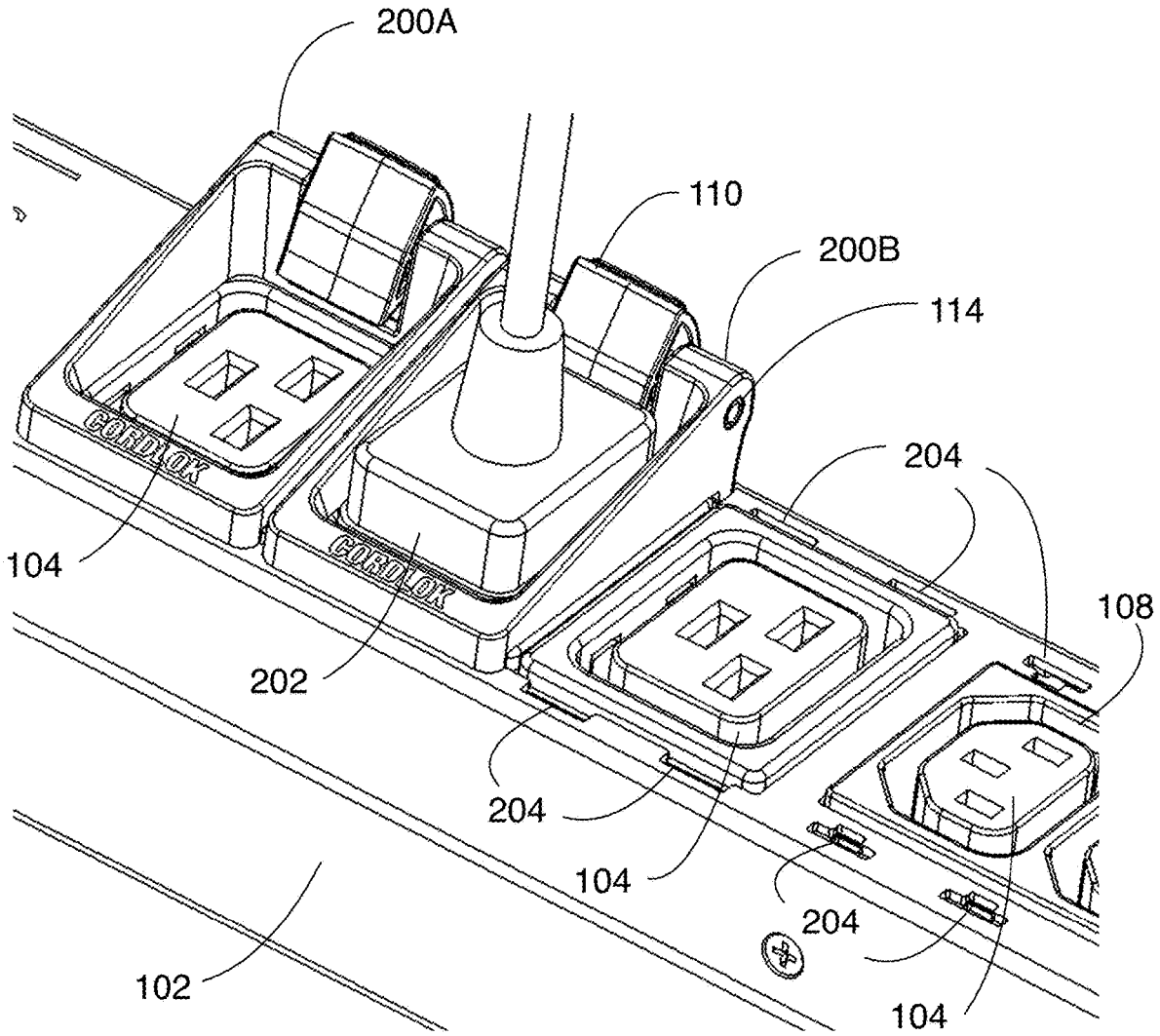
Figure 3:
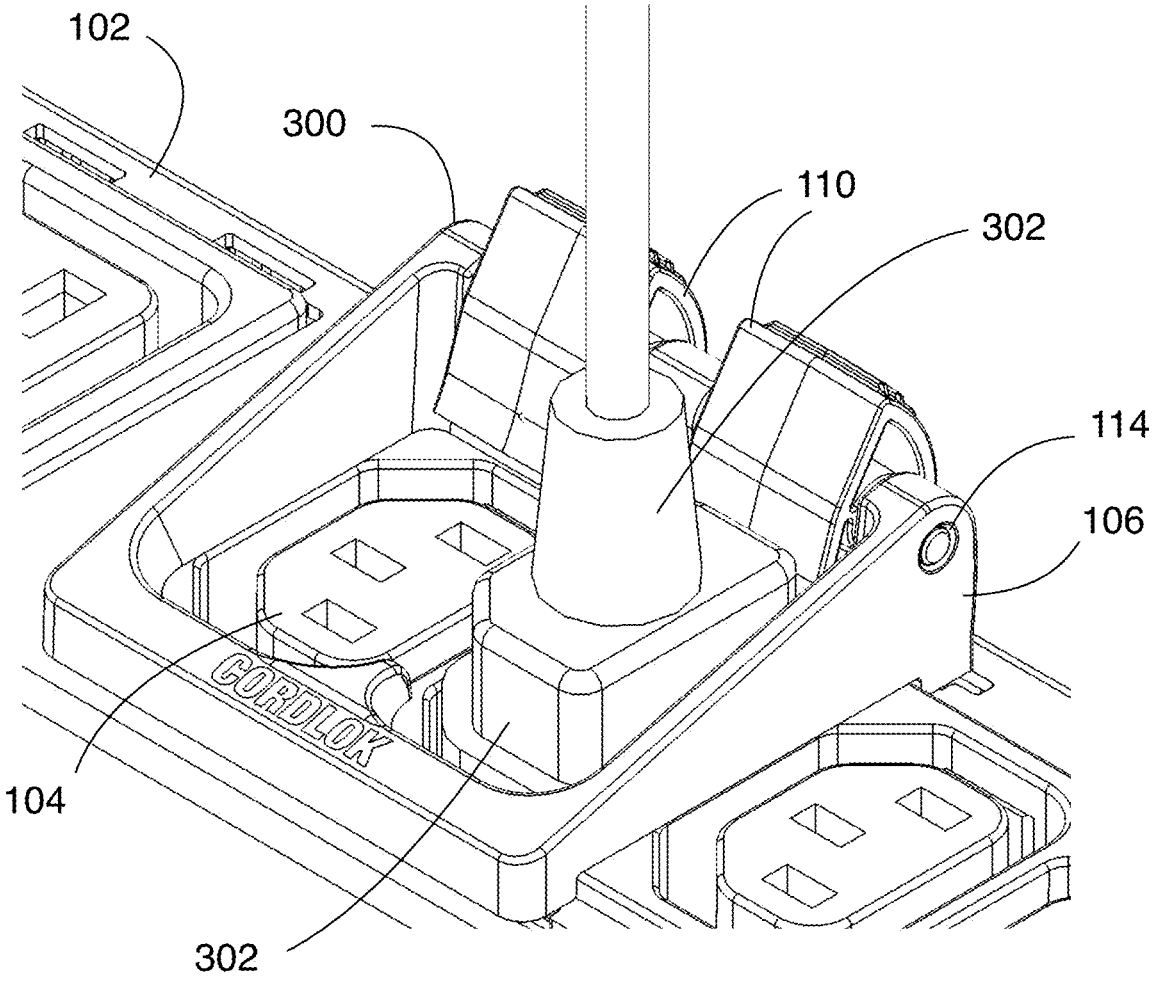
Figure 4:
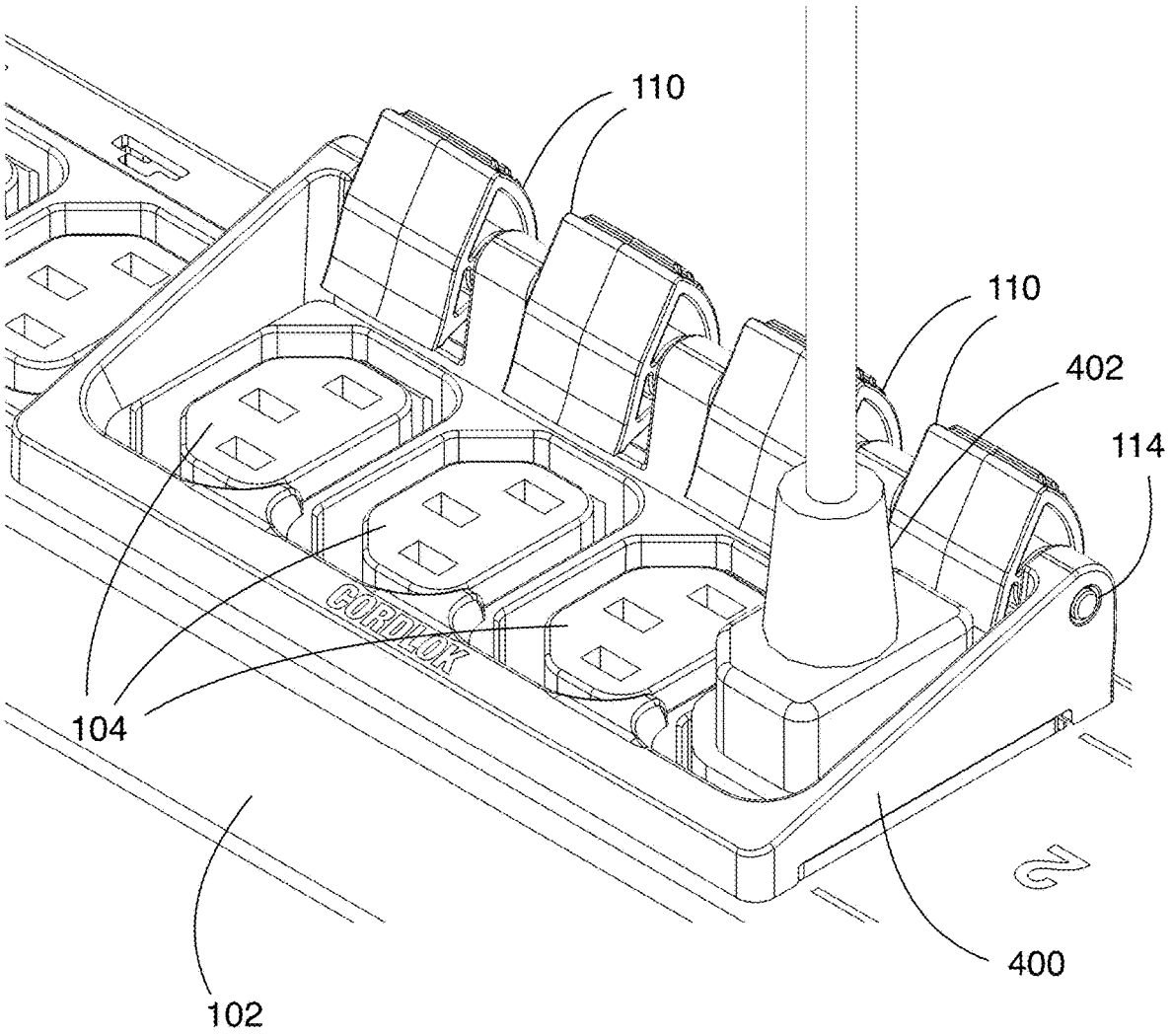
Figure 5:
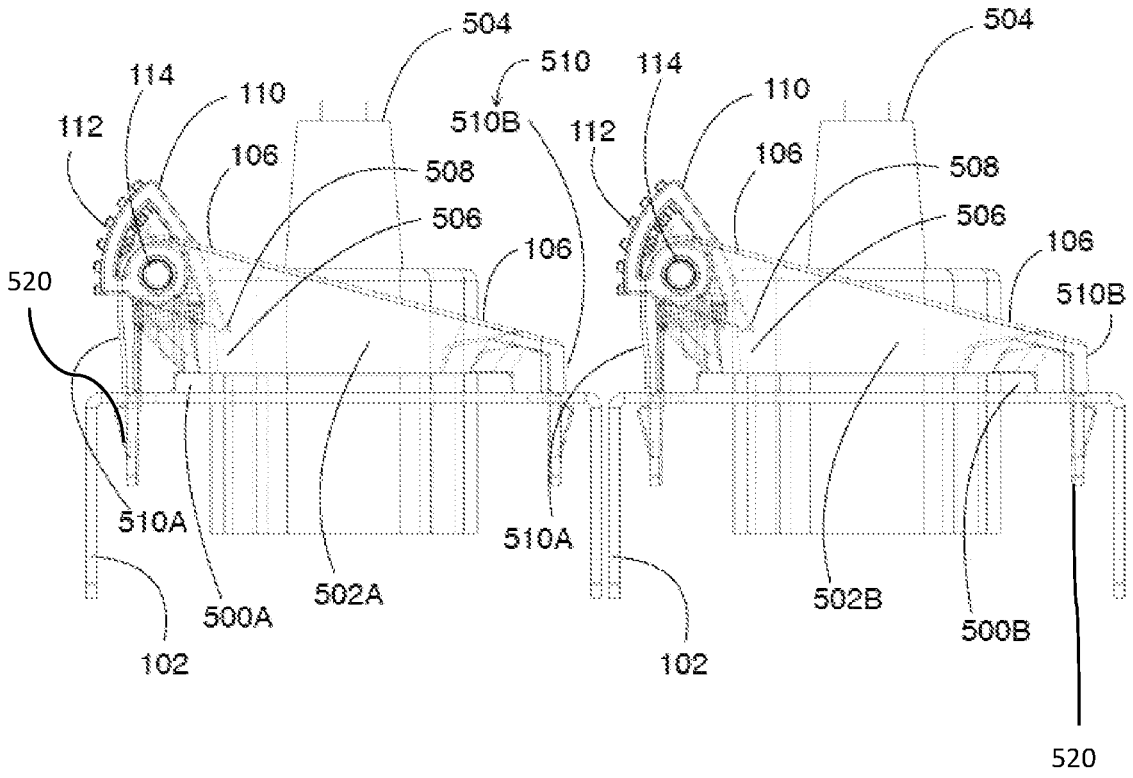
Figure 6:
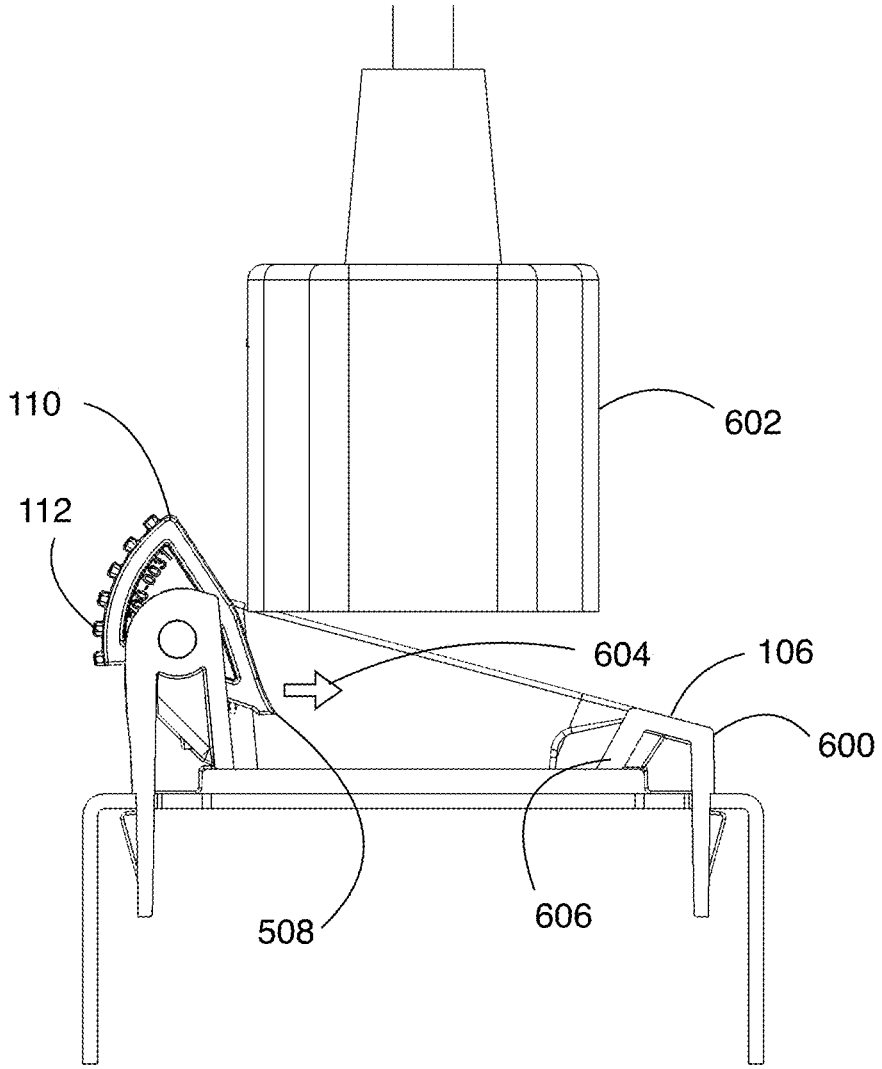
Figure 7:
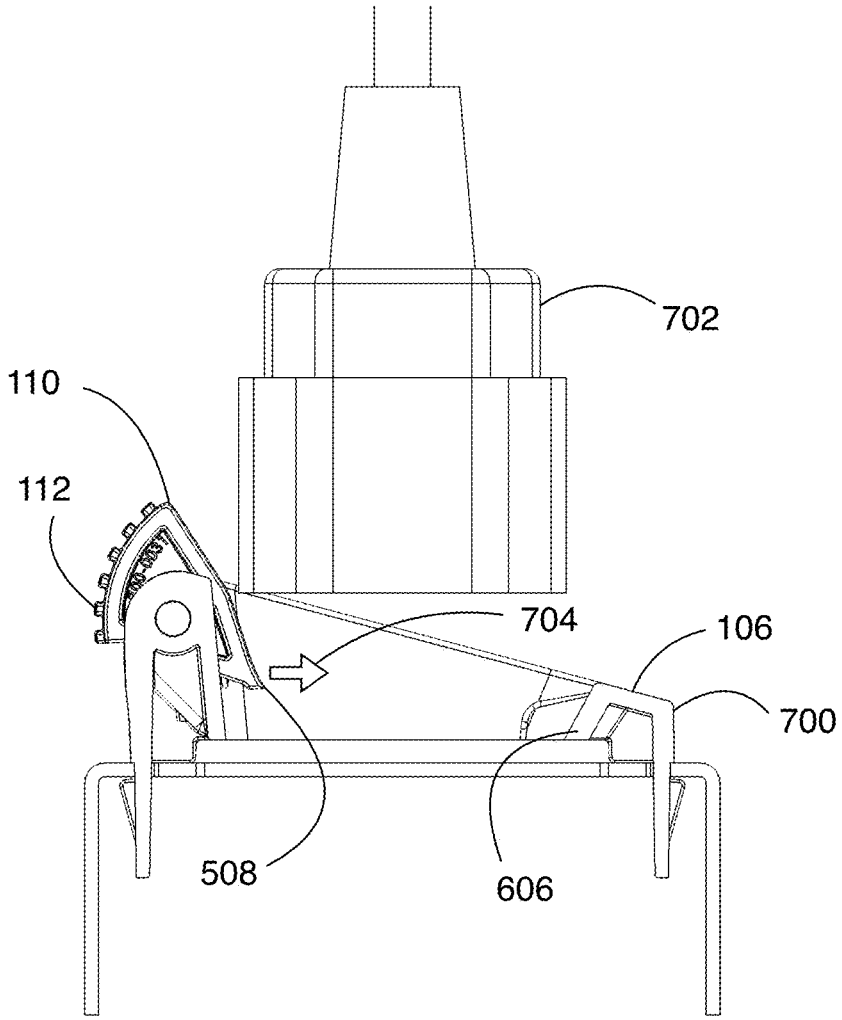
Figure 8:
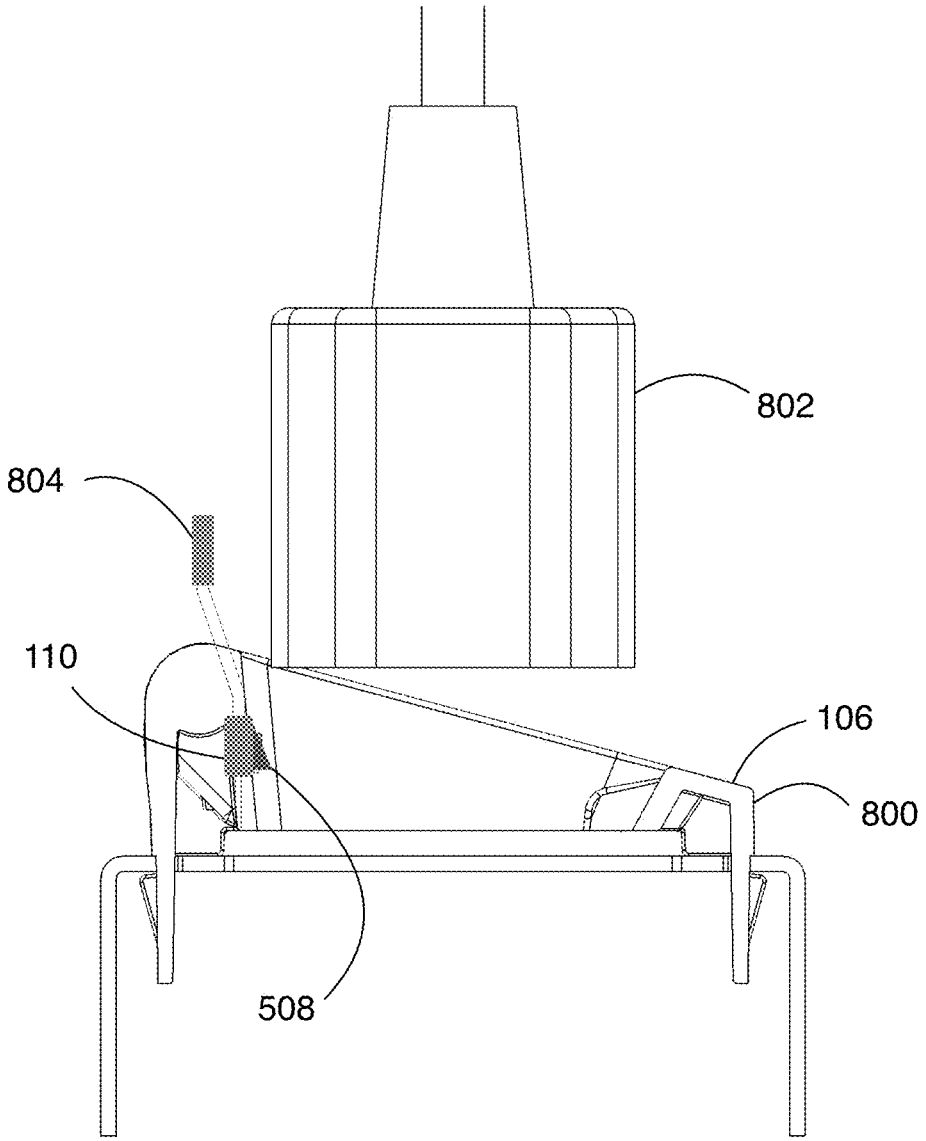
Figure 9:
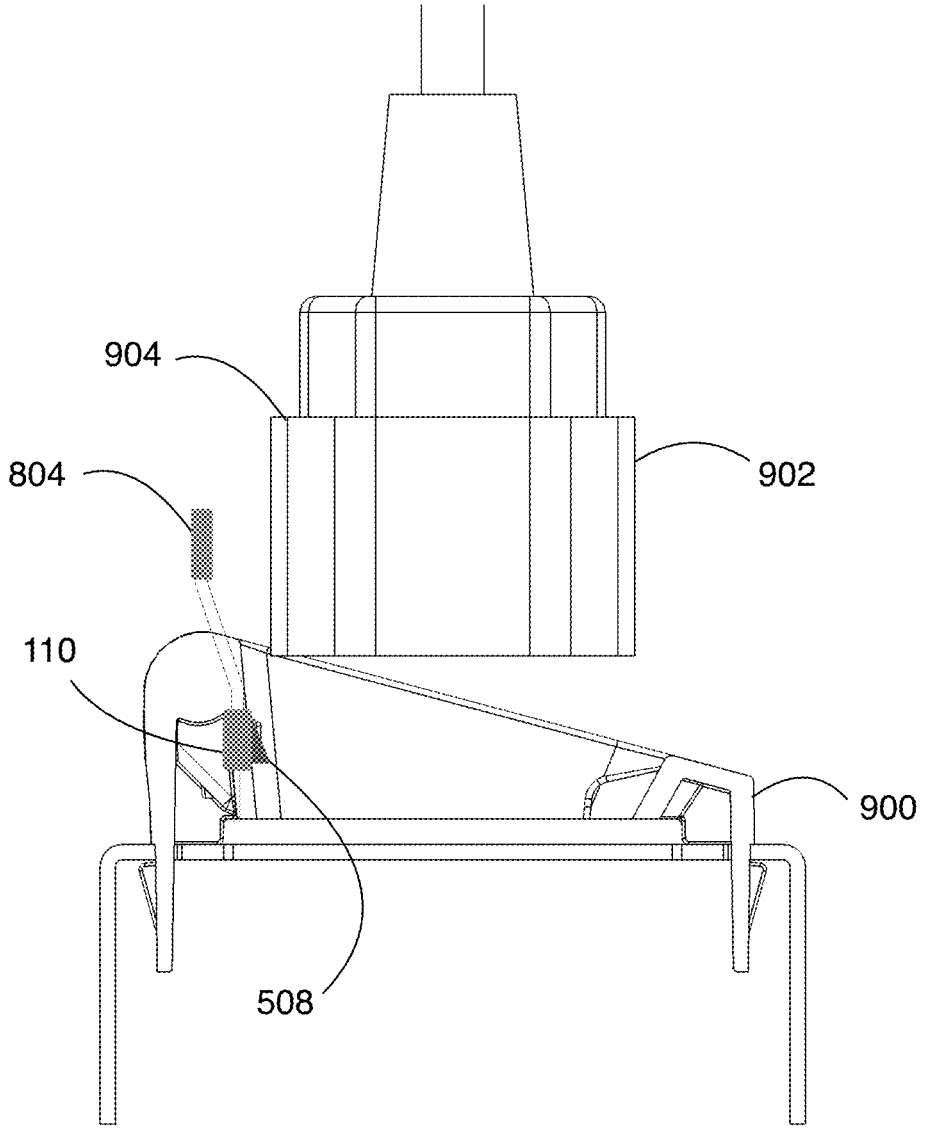
Figure 10:
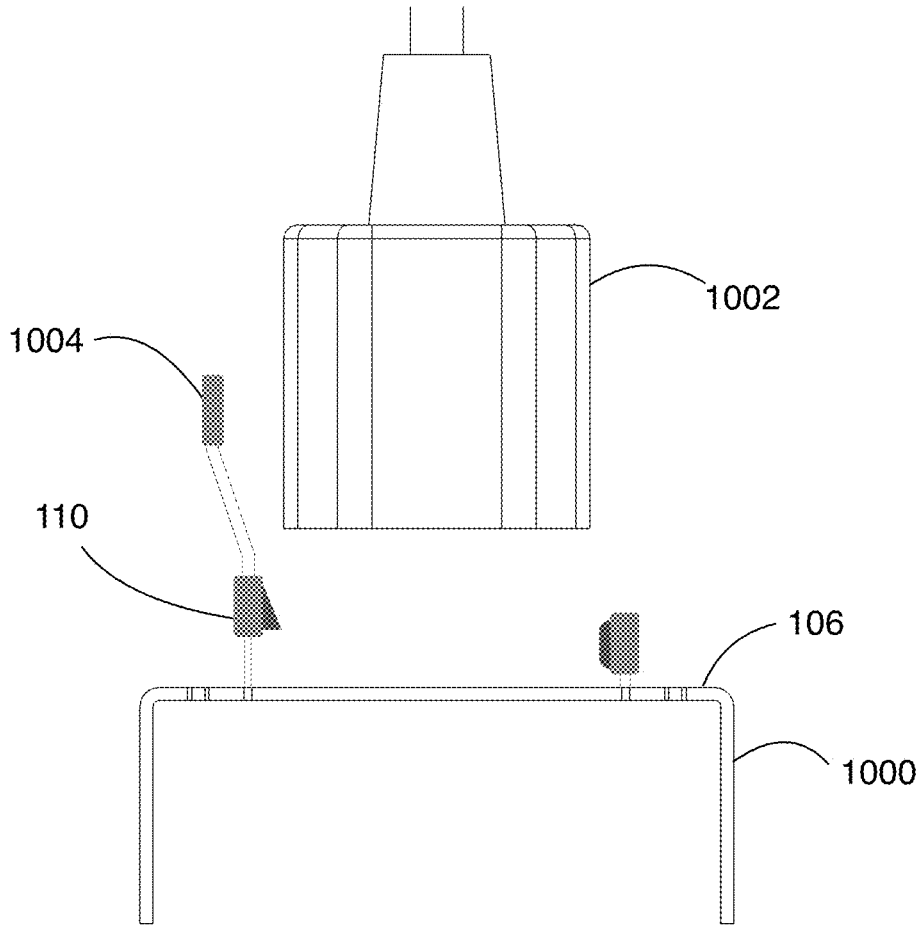
Figure 11:
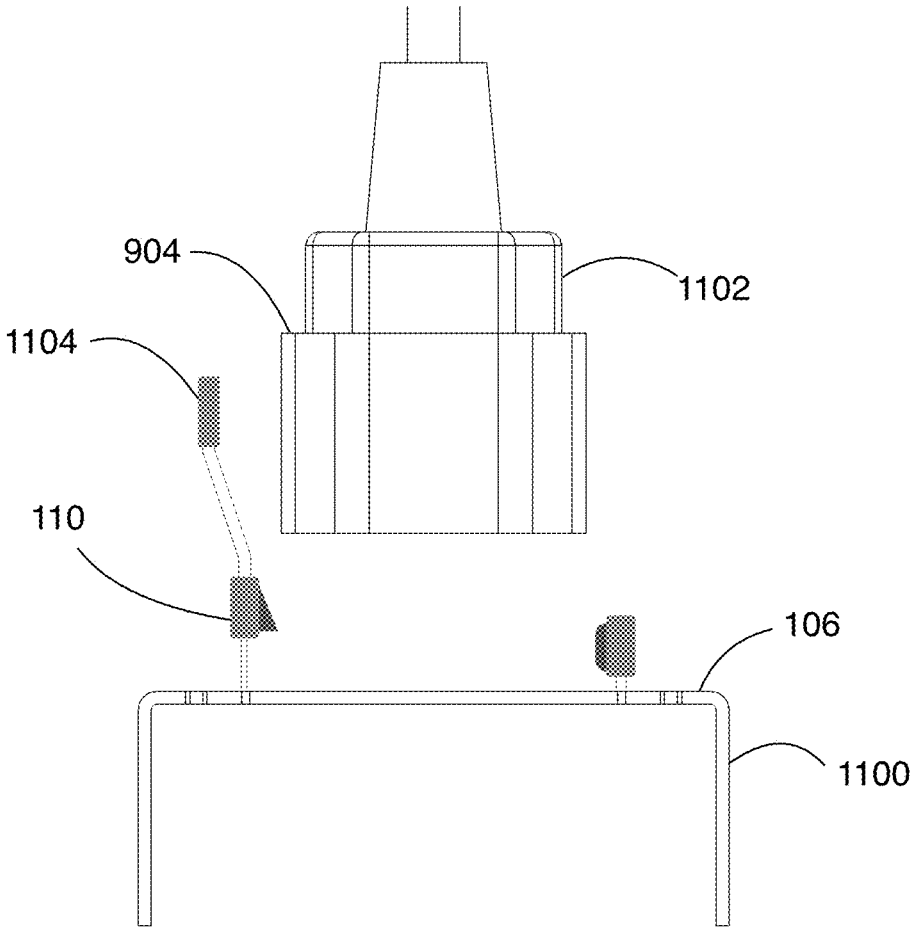

Having thus described the presently disclosed subject matter in general terms, reference will now be made to the accompanying Drawings, which are not necessarily drawn to scale, and wherein:

FIG. 1 is a perspective view of electrical plug latching systems in operation with a PDU in accordance with embodiments of the present disclosure;

FIG. 2 is a perspective view of a PDU having electrical plug latching systems attached thereto in accordance with embodiments of the present disclosure;

FIG. 3 is a perspective view of a PDU having an electrical plug latching system attached thereto in accordance with embodiments of the present disclosure;

FIG. 4 is a perspective view of a PDU having an electrical plug latching system attached thereto in accordance with embodiments of the present disclosure;

FIG. 5 is an end view of a PDU with electrical plug receptacles positioned in close proximity and with electrical plug latching systems attached thereto in accordance with embodiments of the present disclosure;

FIG. 6 is a side view of an electrical plug latching system and an electrical plug of a straight type in accordance with embodiments of the present disclosure;

FIG. 7 is a side view of an electrical plug latching system and an electrical plug of a shelf type in accordance with embodiments of the present disclosure;

FIG. 8 is a side view of another electrical plug latching system and an electrical plug of a straight type in accordance with embodiments of the present disclosure;

FIG. 9 is a side view of another electrical plug latching system and an electrical plug of a shelf type in accordance with embodiments of the present disclosure;

FIG. 10 is a side view of another electrical plug latching system and an electrical plug of a straight type in accordance with embodiments of the present disclosure; and FIG. 11 illustrates a side view of another electrical plug latching system and an electrical plug of a shelf type in accordance with embodiments of the present disclosure.

SUMMARY

The presently disclosed subject matter relates to electrical plug latching systems and related methods. According to an aspect, an electrical plug latching system includes a base having an interface for attachment to an electrical plug receptacle. The base defines an opening for receipt of an electrical plug for electrical connection to the electrical plug receptacle. The electrical plug defines a protrusion. Further, the system includes a latch that is attached to the base and that includes a gripper portion. The gripper portion is moveable between a first position and a second position with respect to the base. In the first position, the gripper portion is positioned to interface with the protrusion of the electrical plug to hold the electrical plug in place when electrically connected to the electrical plug receptacle. In the second position. the gripper portion is positioned apart from the protrusion of the electrical plug.

According to another aspect, an electrical plug latching system includes a base having an interface for attachment to a plurality of electrical plug receptacles. The base defines openings for receipt of a plurality of electrical plugs for electrical connection to the electrical plug receptacles. The electrical plugs each define a protrusion. The system includes latches that are each attached to the base and that each include a gripper portion. Each gripper portion is moveable between a respective first position and a respective second position with respect to the base. In the respective first position, the respective gripper portion is positioned to interface with the protrusion of its respective electrical plug to hold the electrical plug in place when electrically connected to the respective electrical plug receptacle. In the respective second position, the respective gripper portion is positioned apart from the respective protrusion of the respective electrical plug.

According to another aspect, a method of latching an electrical plug to an electrical plug receptacle includes providing an electrical plug latching system. The system includes a base having an opening and an interface attached to an electrical plug receptacle. The system also includes a latch that is attached to the base and that includes a gripper portion. The gripper portion is moveable between a first position and a second position with respect to the base. In the first position, the gripper portion is positioned to interface with a protrusion of an electrical plug to hold the electrical plug in place when electrically connected to the electrical plug receptacle. In the second position, the gripper portion is positioned apart from the protrusion of the electrical plug. The method includes moving the electrical plug through the opening to interface with the electrical plug receptacle. During the movement of the electrical plug to interface with the electrical plug receptacle, the gripper portion moves from between the first and second positions to the first position to hold the electrical plug in place during interface with the electrical plug receptacle.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

FIG. 1 illustrates a perspective view of electrical plug latching systems 100A, 100B, and 100C in operation with a PDU 102 in accordance with embodiments of the present disclosure. Referring to FIG. 1, the PDU 102 has multiple electrical plug receptacles 104 where electrical plugs can interface for powering their respective electronic devices (e.g., servers, desktop computers, laptop computers, tablet computers, smartphones, and the like). System 100A is configured to accommodate 4 electrical plugs, and systems 100B and 100C are each configured to accommodate a single electrical plug. Systems 100A, 100B, and 100C each have a base 106 that is attached to the PDU 102. Base 106 of system 100A devices multiple openings 108 for receipt of a respective electrical plug for electrical connection to their respective electrical receptacles 104. Bases 106 of systems 100B and 100C each include an opening 108 for receipt of a respective electrical plug for electrical connection to its respective electrical receptacle 104.

Systems 100A, 100B, and 100C include latches 110 that are attached to their respective bases 106 for latching an electrical plug to its receptacle 104. Further, a latch 110 can be operated for releasing the electrical plug after latching it to a receptacle 104. A latch 110 includes a gripper portion 112 that is moveable with respect to its respective base 106. Particularly, the gripper portion 112 is moveable between a first position and a second position. In this figure, each gripper portion 112 is positioned in the first position where it can interface with a part of an electrical plug to hold the electrical plug in place when it is electrically connected to its receptacle. Each latch 110 has a mechanism (not shown in FIG. 1) that biases the latch 110 to be positioned in the first position. The latch 110 can be manually moved by a user to its second position whereby the latch 110 releases the plug such that it can be removed from interface with its receptacle. The plug can be released when the gripper portion 112 is in the second position because the gripper 112 is released from interfacing with the electrical plug. In this example, the gripper portion 112 can rotatably move between the positions by rotating upon its respective pivot pin 114, which is attached to its respective base 106.

With continuing reference to FIG. 1, the receptacles 104 of system 100A are C13 type electrical plug receptacles. The receptacles 104 of system 100B and 100C are C19 type electrical plug receptacles. It is noted that the electrical plug latching systems may be used with or modified to be used with any suitable electrical plug receptacles and PDUs.

FIG. 2 illustrates a perspective view of a PDU 102 having electrical plug latching systems 200A and 200B attached thereto in accordance with embodiments of the present disclosure. Referring to FIG. 2, the PDU 102 has C19 type electrical plug receptacles 104. An electrical plug 202 is plugged into or electrically connected to the electrical plug receptacle associated with system 200B. In this example, an underside of each base 200A and 200B has a snap component (not shown) for attachment to an electrical plug receptacle. For example, the right-most receptacle 104 does not have an electrical plug latching system attached thereto such that its interfaces 204 (e.g., apertures for receiving and mating to inserts of the snap component) for receiving the snap component are shown. Advantageously, for example, the bases 200A and 200B are of a compact shape and size such that they can be positioned beside each other.

FIG. 3 illustrates a perspective view of a PDU 102 having an electrical plug latching system 300 attached thereto in accordance with embodiments of the present disclosure. Referring to FIG. 3, the PDU 102 has C13 type electrical plug receptacles 104. An electrical plug 302 is plugged into or electrically connected to one of the electrical plug receptacles. Advantageously, for example, the base 106 is of a compact shape and size such that it can be positioned beside another base.

FIG. 4 illustrates a perspective view of a PDU 102 having an electrical plug latching system 400 attached thereto in accordance with embodiments of the present disclosure. Referring to FIG. 4, the PDU 102 has C13 type electrical plug receptacles 104. An electrical plug 402 is plugged into or electrically connected to one of the electrical plug receptacles.

FIG. 5 illustrates an end view of two PDUs 102A and 102B with electrical plug receptacles 500A and 500B positioned in close proximity and with electrical plug latching systems 502A and 502 attached thereto in accordance with embodiments of the present disclosure. Referring to FIG. 5, the latches 110 each include an outside surface where the gripper portion 112 is located for an operator to use his or her forefinger or thumb to move the respective latch 110 between the first position (which is shown in FIG. 5) and a second position in which the respective plug 504 can be removed. As shown, the gripper portion 112 defines multiple ridges for ease of operation by the operator.

As shown in FIG. 5, each electrical plug 504 defines a protrusion 506 on a side thereof. Each latch 110 includes a feature 508 that can be positioned when the latch 110 is in the first position for holding onto its associated protrusion 506 for holding the electrical plug 504 in position. Further, when the plug 504 is near to being fully inserted into the receptacle, the latch 110 can be operated to move the latch 110 to the first position and to move the feature 508 to push the protrusion 506 for urging the plug fully into the receptacle.

With continuing reference to FIG. 5, each base defines a first side 510A and a second side 510B. The opening of each base 106 is positioned between the first side 510A and the second side 510B. As shown, the latch 110 is attached to the first side 510A. The first side 510A extends from the receptacles further than the second side 510B. Advantageously, for example, the lower second side 510B provides an area (generally designated 510) for the operator to move the latch 110. Further, for example, the positioning of the latch 110 can provide for an operator to move the latch 110 to release the plug from hold (such as by use of a thumb) and to pull the plug from the receptacle (such as by use of other fingers of the same hand) simultaneously or near simultaneously. Snap components 520 can each attach to a respective interface, such as an interface 204 shown in FIG. 2. The snap components 520 and/or other components of the base 106 can be considered an interface for attachment to an electrical plug receptacle.

In accordance with embodiments, FIG. 6 illustrates a side view of an electrical plug latching system 600 and an electrical plug 602 of a straight type. The latch 110 is spring-loaded to bias feature 508 towards the plug 602 in a direction indicated by arrow 604 such that the feature 508 can hold onto a feature defined by the plug 602 when the plug 602 is fully connected to the receptacle. The feature 508 can be released when the latch 110 is operated to move it from the first position. It is noted that movement of the plug 602 to be inserted can force the latch 110 to pivot until the feature 508 fits into the feature of the plug 602. It is noted that the base 600 can be attached to a PDU by any suitable manner such as by a snap, adhesive, or other suitable type of fastening technique.

Within continuing reference to FIG. 6, the base 600 defines a protrusion 606 that is attached to a side of the base that opposes the side of attached of the latch 110. The protrusion 606 extends into the opening of the base 600 for contacting the plug 602 to urge the plug 602 towards the latch 110.

In accordance with embodiments, FIG. 7 illustrates a side view of an electrical plug latching system 700 and an electrical plug 702 of a shelf type. The latch 110 is spring-loaded to bias feature 508 towards the plug 702 in a direction indicated by arrow 704 such that the feature 508 can hold onto a feature defined by the plug 702 when the plug 702 is fully connected to the receptacle. The feature 508 can be released when the latch 110 is operated to move it from the first position. It is noted that movement of the plug 702 to be inserted can force the latch 110 to pivot until the feature 508 fits into the feature of the plug 702.

FIG. 8 illustrates a side view of another electrical plug latching system 800 and an electrical plug 802 of a straight type in accordance with embodiments of the present disclosure. Referring to FIG. 8, the system 800 in this example include an arm 804 that extends away from the base 106 and that is configured for manual movement of the latch 110 between the first position and the second position. The feature 508 is attached to the arm 804 and can hold onto a feature defined by the plug 802 when the plug 802 is fully connected to the receptacle. The feature 508 can be released when the arm 804 is operated to move it from the first position. It is noted that movement of the plug 802 to be inserted can force the arm 804 to pivot until the feature 508 fits into the feature of the plug 802.

FIG. 9 illustrates a side view of another electrical plug latching system 900 and an electrical plug 902 of a shelf type in accordance with embodiments of the present disclosure. Referring to FIG. 9, the system 900 in this example include an arm 804 that extends away from the base 106 and that is configured for manual movement of the latch 110 between the first position and the second position. The feature 508 is attached to the arm 804 and can hold onto a feature 904 defined by the plug 902 when the plug 902 is fully connected to the receptacle. The feature 508 can be released when the arm 804 is operated to move it from the first position. It is noted that movement of the plug 902 to be inserted can force the arm 804 to pivot until the feature 508 fits onto the feature 904 of the plug 802.

FIG. 10 illustrates a side view of another electrical plug latching system 1000 and an electrical plug 1002 of a straight type in accordance with embodiments of the present disclosure. Referring to FIG. 10, the system 1000 in this example include an arm 804 that extends away from the base 106 and that is configured for manual movement of the latch 110 between the first position and the second position. The feature 508 is attached to the arm 1004 and can hold onto a feature defined by the plug 1002 when the plug 1002 is fully connected to the receptacle. The feature 508 can be released when the arm 1004 is operated to move it from the first position. It is noted that movement of the plug 1002 to be inserted can force the arm 1004 to pivot until the feature 508 fits into the feature of the plug 1002.

FIG. 11 illustrates a side view of another electrical plug latching system 1100 and an electrical plug 1102 of a shelf type in accordance with embodiments of the present disclosure. Referring to FIG. 11, the system 1100 in this example include an arm 1104 that extends away from the base 106 and that is configured for manual movement of the latch 110 between the first position and the second position. The feature 508 is attached to the arm 804 and can hold onto a feature 904 defined by the plug 1102 when the plug 1102 is fully connected to the receptacle. The feature 508 can be released when the arm 1104 is operated to move it from the first position. It is noted that movement of the plug 1102 to be inserted can force the arm 1104 to pivot until the feature 508 fits onto the feature 904 of the plug 802.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. An electrical plug latching system comprising:

a latch; and a base including an interface for attachment to an electrical plug receptacle, the base defining an opening for receipt of an electrical plug for electrical connection to the electrical plug receptacle, wherein the electrical plug defines a protrusion, wherein the base comprises a first side and a second side at opposing sides of the opening and extending from the opening, wherein the first side extends further from the opening than the second side to provide space adjacent the second side and expose the latch; and wherein the latch is attached to the first side of the base and includes a gripper portion, the gripper portion being moveable between a first position and a second position with respect to the base, wherein in the first position the gripper portion is positioned to interface with the protrusion of the electrical plug to hold the electrical plug in place when electrically connected to the electrical plug receptacle, and wherein in the second position the gripper portion is positioned apart from the protrusion of the electrical plug.

2. The electrical plug latching system of claim 1, wherein the interface of the base comprises a snap component for attachment to a power distribution unit of the electrical plug receptacle.

3. The electrical plug latching system of claim 1, wherein the electrical plug receptacle is one of a plurality of electrical plug receptacles of a power distribution unit.

4. The electrical plug latching system of claim 1, wherein the opening of the base substantially surrounds the electrical plug when the electrical plug is electrically connected to the electrical plug receptacle.

5. The electrical plug latching system of claim 1, wherein the latch comprises a mechanism that biases the gripper portion to be positioned in the first position.

6. The electrical plug latching system of claim 5, wherein the mechanism comprises a spring configured to urge the gripper portion in a direction towards the first position.

7. The electrical plug latching system of claim 1, wherein the latch includes an outside surface for manual movement of the gripper portion between the first position and the second position.

8. The electrical plug latching system of claim 7, wherein the outside surface defines a plurality of ridges.

9. The electrical plug latching system of claim 1, wherein the latch includes an arm that extends away from the base and configured for manual movement of the gripper portion between the first position and the second position.

10. The electrical plug latching system of claim 1, wherein the latch is pivotally attached to the base.

11. The electrical plug latching system of claim 1, wherein the protrusion is defined on a first side of the electrical plug, wherein the electrical plug defines a second side that opposes the first side, and wherein the latch is attachable to a first side of the base, and wherein the base defines a protrusion that is attachable to a second side of the base and that extends into the opening for contacting the electrical plug to urge the electrical plug towards the latch.

12. The electrical plug latching system of claim 11, wherein the protrusion of the base is resilient.

13. The electrical plug latching system of claim 1, wherein the opening is positioned between the first side and the second side, wherein the latch is attached to the first side, and wherein the first side extends from the electrical plug receptacle further than the second side.

14. The electrical plug latching system of claim 1, wherein the electrical plug receptacle is one of a C13 and C19 type electrical plug receptacle.

15. An electrical plug latching system comprising:

a plurality of latches; and a base including an interface for attachment to a plurality of electrical plug receptacles, the base defining a plurality of openings for receipt of a plurality of electrical plugs for electrical connection to the electrical plug receptacles, wherein the electrical plugs each define a protrusion, wherein for each opening the base comprises a first side and a second side at opposing sides of the respective opening, wherein the first side and the second side extend from its respective opening, wherein for adjacent openings the first side of one of the openings is adjacent the second side of the other opening, wherein the first side extends further from the opening than the second side to provide space adjacent the second side and expose its respective latch; and wherein the plurality of latches are attached to the first side of the base and each includes a gripper portion, each gripper portion being moveable between a respective first position and a respective second position with respect to the base, wherein in the respective first position the respective gripper portion is positioned to interface with the protrusion of a respective electrical plug to hold the electrical plug in place when electrically connected to the respective electrical plug receptacle, and wherein in the respective second position the respective gripper portion is positioned apart from the respective protrusion of the respective electrical plug.

16. The electrical plug latching system of claim 15, wherein the interface of the base comprises a snap component for attachment to the electrical plug receptacle.

17. The electrical plug latching system of claim 15, wherein the electrical plug receptacles are the electrical plug receptacles of a power distribution unit.

18. The electrical plug latching system of claim 15, wherein each latch comprises a mechanism that biases its gripper portion to be positioned in its respective first position.

19. A method of latching an electrical plug to an electrical plug receptacle, the method comprising:

providing an electrical plug latching system comprising:

a latch; and a base including an opening and an interface attached to an electrical plug receptacle, the base defining an opening for receipt of an electrical plug for electrical connection to the electrical plug receptacle, wherein the electrical plug defines a protrusion, wherein the base comprises a first side and a second side at opposing sides of the opening and extending from the opening, wherein the first side extends further from the opening than the second side to provide space adjacent the second side and expose the latch; and wherein the latch is attached to the first side of the base and includes a gripper portion, the gripper portion being moveable between a first position and a second position with respect to the base, wherein in the first position the gripper portion is positioned to interface with a protrusion of an electrical plug to hold the electrical plug in place when electrically connected to the electrical plug receptacle, and wherein in the second position the gripper portion is positioned apart from the protrusion of the electrical plug; and moving the electrical plug through the opening to interface with the electrical plug receptacle, wherein during the movement of the electrical plug to interface with the electrical plug receptacle the gripper portion moves from between the first and second positions to the first position to hold the electrical plug in place during interface with the electrical plug receptacle.

20. The method of claim 19, further comprising moving the gripper portion from the first position such that the electrical plug is released from being held by the gripper portion.

* * * * *